United States Patent [19]

Hymmen

[11] Patent Number: 4,625,996

[45] Date of Patent: Dec. 2, 1986

[54] BOOKBINDING STRIPS AND METHOD OF BINDING BOOKS EMPLOYING SERRATED STUDS

[75] Inventor: Karl Hymmen, Sparks, Nev.

[73] Assignee: Velo-Bind, Inc., Sunnyvale, Calif.

[21] Appl. No.: 741,956

[22] Filed: Jun. 6, 1985

[51] Int. Cl.[4] ..... B42D 1/00; B42F 13/06; B42F 3/00

[52] U.S. Cl. ..... 281/21 A; 402/16; 402/63; 412/43

[58] Field of Search ..... 281/21 A; 402/8, 13, 402/14, 17, 18, 60, 61, 62, 63, 64, 80 P, 68, 16; 412/43

[56] References Cited

U.S. PATENT DOCUMENTS

| | | | |
|---|---|---|---|
| 2,192,701 | 3/1940 | Vogel | 402/16 |
| 3,211,156 | 10/1965 | Dennis | 402/18 |
| 3,224,449 | 12/1965 | Potts | 402/17 |
| 4,121,892 | 10/1978 | Mes | 402/17 |
| 4,202,642 | 5/1980 | Sjostedt | 402/17 |
| 4,304,499 | 12/1981 | Purcocks | 402/63 |
| 4,305,675 | 12/1981 | Jacinto | 402/63 |
| 4,369,013 | 1/1983 | Abildgaard et al. | 402/80 P |

*Primary Examiner*—Paul A. Bell
*Assistant Examiner*—Paul M. Heyrana, Sr.
*Attorney, Agent, or Firm*—Julian Caplan

[57] ABSTRACT

A first plastic strip has longitudinally spaced studs each of which can be bent over at a 90° angle, the studs being serrated. A second strip has holes through which the studs fit and grooves which receive and secure the bent over studs, the grooves being serrated. Paper punched to receive the studs is clamped between the two strips. The studs are then bent over into grooves in the second strip and held in bent position in part by said teeth intermeshing. The paper is thus securely bound.

13 Claims, 11 Drawing Figures

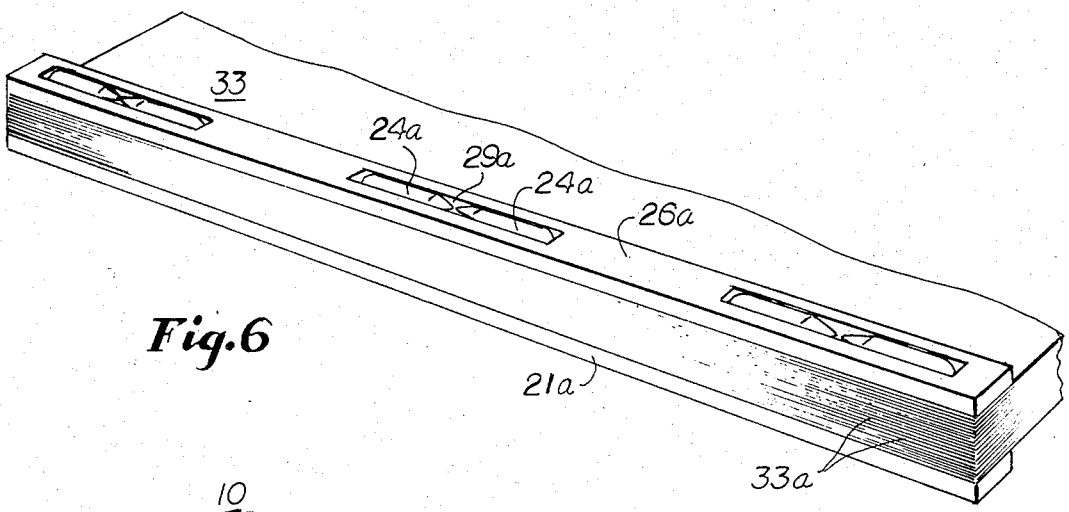
Fig.6
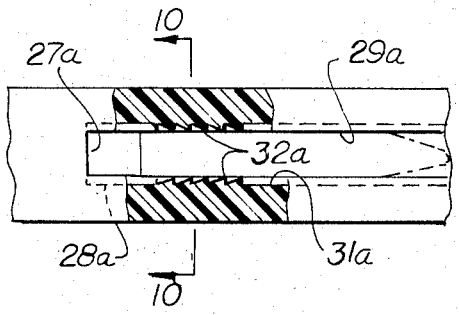
Fig.9
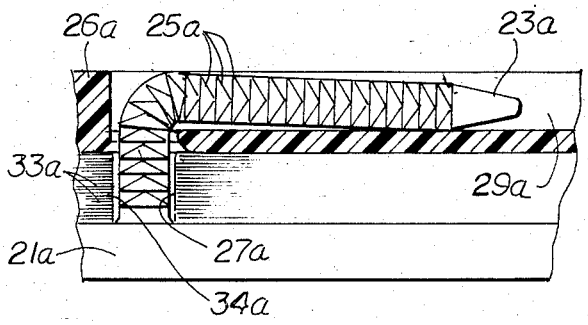
Fig.8
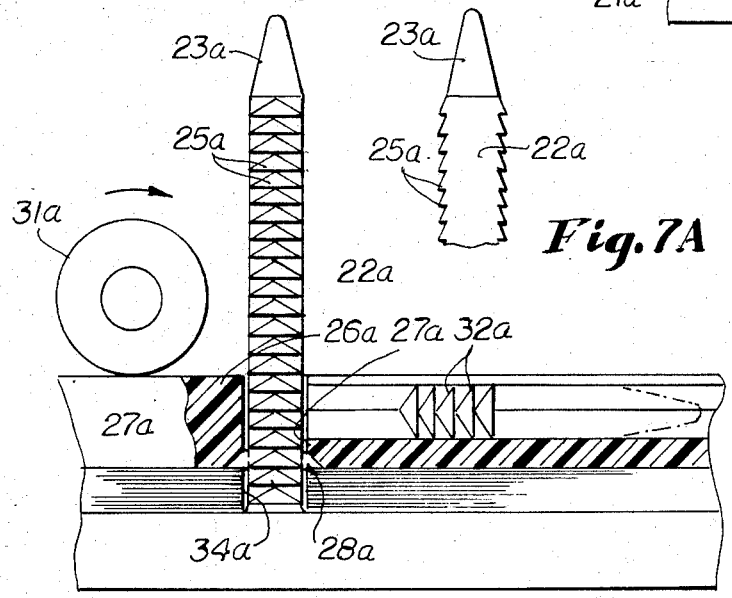
Fig.7A
Fig.7
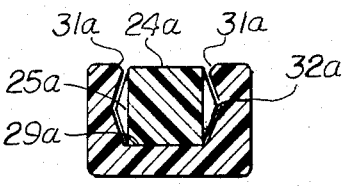
Fig.10

BOOKBINDING STRIPS AND METHOD OF BINDING BOOKS EMPLOYING SERRATED STUDS

CROSS REFERENCE TO RELATED APPLICATIONS

This invention is an improvement upon William H. Abildgaard application Ser. No. 06/663,214, filed Oct. 22, 1984 for bookbinding strips and method of binding books, owned by the assignee of this application.

BACKGROUND OF THE INVENTION

1. Field of the Invention

This invention relates to a new and improved bookbinding strip and method of binding books. A popular bookbinding system uses a pair of strips, one strip having relatively rigid thermoplastic studs projecting therefrom, the other having holes to receive the studs. Paper formed with holes complementary to the studs is clamped between the pair of strips, the excess stud lengths are cut off and the ends of the studs preferably formed with rivet heads, completing the bind. The present invention uses flexible studs, and grooves are formed in the second strip to receive the bent over stud lengths. In order to improve the quality of the bind, the studs are serrated and the edges of the grooves in the female strip are also serrated to improve the grip of the female strips on the studs.

2. Description of the Prior Art

U.S. Pat. No. 4,369,013 shows commercially available pairs of plastic strips. The present invention differs from such strips in three respects: first, the studs are flexible; second, grooves are formed in the female strip to receive the studs; and, third, serrations are formed in the studs and in the grooves to interlock.

Serrated studs are shown in British Pat. No. 950,768 to Baumgart; however such studs are not bent over to be slipped into channels nor are the channels serrated.

Flexible studs of various types have been used for binding computer paper and the like, but such binding strips require complicated means for holding the bent over studs in place.

OBJECTS OF PRESENT INVENTION AND SUMMARY THEREOF

The present invention provides a female strip formed with grooves and serrations along at least portions of the sides of the grooves to receive flexible studs of the opposite member which are serrated in complementary manner. A very secure bind is accomplished without the use of machinery for cutting and riveting studs and without the use of complicated retaining means for retaining the studs in position.

More particularly, it is an object of this invention to provide a pair of strips, one having longitudinally spaced flexible plastic studs and the other having holes complementary to the spacing of the studs adjacent one or more grooves into which bent over studs may be inserted, both the studs and the sides of the grooves being serrated.

A further object of the invention is to provide binding means which does not require cutting or heading of the studs. Thus the bind may be accomplished manually or with very simple apparatus.

Mechanical simplicity of the strips is a further object of the invention. No movable locking means is required nor is riveting required.

Since it is unnecessary to cut off excess scrap length, disposal of scrap is not a problem.

A still further object of the invention is that by the use of flexible studs, unsnapping the bent stud ends from the retaining means is possible, thus permitting removing the female strip, adding or subtracting sheets and then rebinding the book. If a permanent bind is desired, the stud ends or strip may be permanently deformed as by heat.

The strength of the bind of the present invention is highly satisfactory in that it permits binding thick books without likelihood that the studs will be detached from the channels.

Other objects of the present invention will become apparent upon reading the following specification and referring to the accompanying drawings in which similar characters of reference represent corresponding parts in each of several views.

In the drawings:

FIG. 6 is a view similar to FIG. 1 of a modification wherein the studs are non-circular.

FIG. 7 is a view similar to FIG. 2 of the modification of FIG. 6.

FIG. 7A is a fragmentary view of the stud of FIG. 7 turned 90 degrees.

FIGS. 8, 9 and 10 are views similar to FIGS. 3, 4 and 5, respectively, showing the modification of FIG. 6.

DESCRIPTION OF PREFERRED EMBODIMENTS

Figure 1:
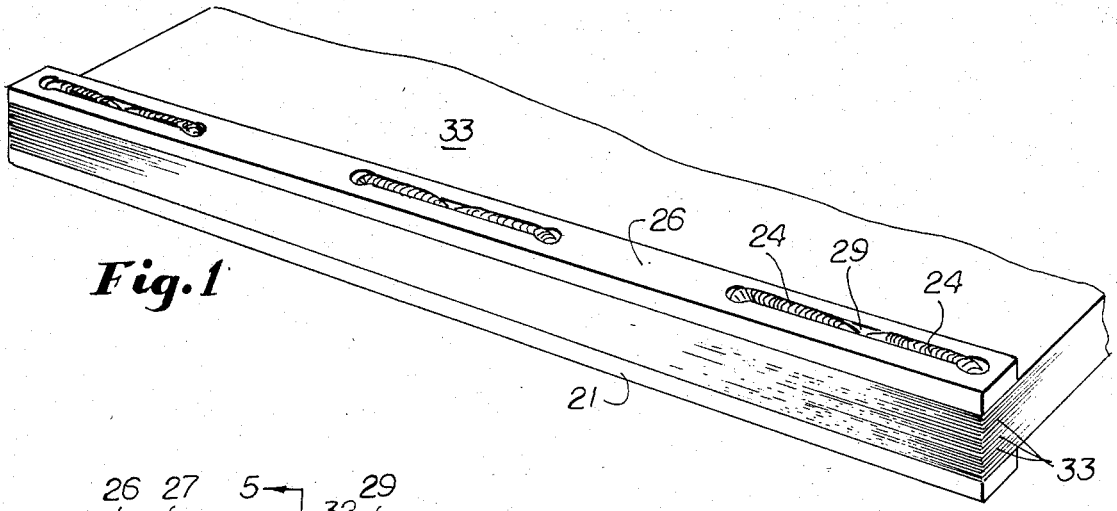
FIG. 1 is a sectional view, partly broken away to conserve space illustrating use of the present invention.
Figure 4:
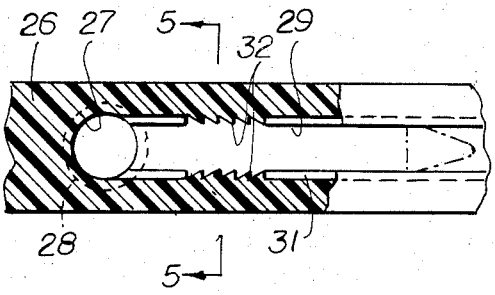
FIG. 4 is a top planned view of the structure of FIG. 3.
Figure 3:
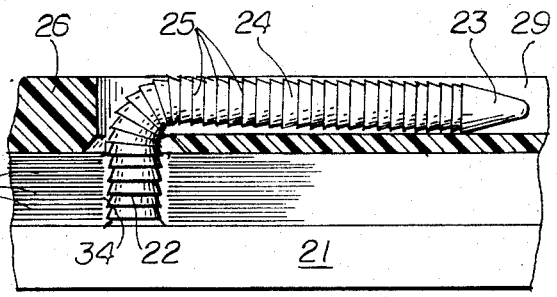
FIG. 3 is a view similar to FIG. 2 showing the stud bent over.

In the form of the invention shown in FIGS. 1–5, there is provided a male strip 21, preferably of a thin, narrow plastic material. Either integral therewith or inserted therein at spaced intervals along the strip 31 are flexible plastic studs 22 having pointed ends 23. Serrations 25 are formed along the length of the studs 22. The material of the studs 22 may be of polypropylene, polyethelene, K-resin and any of a group of thermoplastic elastomers. The stud length is in excess of the length necessary to accommodate the thickness of the pages being bound. The flexible nature of the plastic material of which the studs 22 is formed makes it possible to bend the studs at a relatively abrupt angle, specifically 90 degrees. The bent over stud portion is indicated by reference numeral 24 herein.

The female strip 26 is likewise preferably of plastic and is formed with spaced holes 27 complementary to the spacing of the studs 22. To facilitate the tips 23 being inserted in holes 27, the bottom surface of strips 26 is preferably formed with counterbores 28 or countersinks at each of holes 27. The top surface of strip 26 is formed with one or more longitudinally extending grooves 29 to receive the bent portions 24. The grooves 29 are formed with overhangs 31 along each upper edge. Thus the bent over portion 24 snaps between the overhangs 31. Further, at least throughout a portion of the length of each groove 29 and relatively adjacent the holes 27 the sides of the channels are formed with serrations 32 complementary to the serrations 25.

Figure 2:
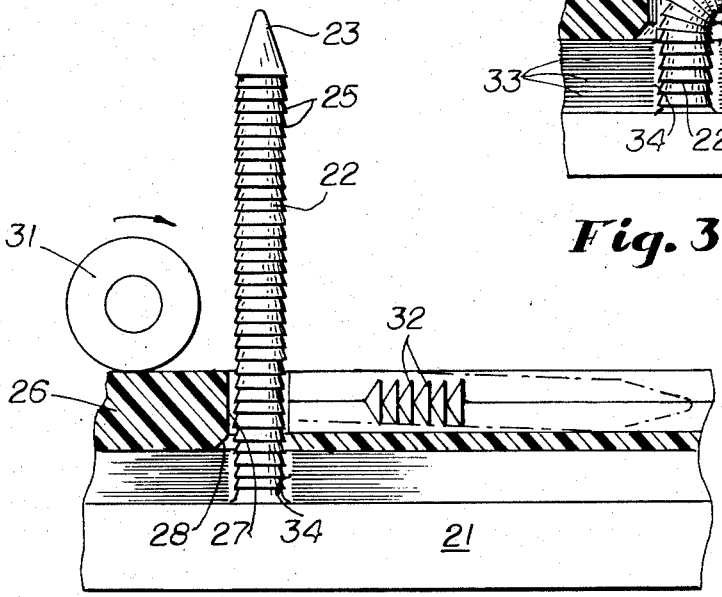
FIG. 2 is a fragmentary sectional view showing the book assembled immediately prior to bending over of the stud.
Figure 5:
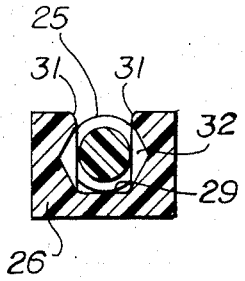
FIG. 5 is a fragmentary cross-section taken substantially along the line 5—5 of FIG. 4.

The book of the present invention is used to bind a plurality of sheets 33 formed with holes 34 complementary to the spacing of the studs 22. Referring to FIG. 2, strip 21 is placed with studs 22 projecting upright. Sheets 33 are then assembled on the studs 22. Thereupon the second strip 26 is installed over the studs 22, the counterbores 27 facilitating entry of the pointed ends 23. Thereupon the studs 23 are bent over at a right angle into the grooves 29. As shown schematically in FIG. 4, a roller 36 may cause the studs to be bent. The excess stud lengths 24 snap between the overhangs 21 and the serrations 32 engage some of the serrations 25.

Directing attention to FIG. 1, it will be seen that alternate studs are bent in opposite directions. However, this is a matter of choice and all or most of the studs may be bent in the same direction or various combinations of bending directions may be employed.

In the modification of FIGS. 1–5, the studs 22 are round in cross-section. However, this shape is subject to variation. As shown in FIGS. 6–10, the studs **22*a* are square in cross-section and on two opposite edges are formed with serrations 25*a*. These serrations fit into the serrations 32*a* along portions of the sides of groove 29*a***.

In other respects the modification of FIGS. 6–10 resembles that of FIGS. 1–5 and the same reference numerals followed by the subscript a are used to designate corresponding parts.

What is claimed is:

1. A book comprising a plurality of sheets each formed with at least four regularly spaced apart first holes spaced longitudinally of the spine edge of said sheet, a first strip, a second strip formed with a plurality of second holes at the same intervals as said first holes and a groove in the outer surface of said second strip for each said second hole communicating with one of said second holes, and a plurality of plastic studs integral with said first strip, each said stud extending outward from said first strip through a first said hole and a second said hole and being flexible and bendable at approximately a 90° angle, the ends of said studs beyond said second holes being bent at approximately right angles and received in said grooves, the lengths of said grooves being complementary to said studs, and retaining means retaining said ends of said studs within said grooves, said retaining means comprising overhangs along at least one longitudinal edge of each said groove adjacent only the outside of said groove, first teeth formed in said studs and for each said groove second teeth formed on at least one side of said groove complementary to said first teeth adjacent said second hole, said overhang extending from said second teeth to the end of said groove opposite said second hole and being smooth surfaced, said studs being snapped under said overhang.

2. A book according to claim 1 in which said studs are integral with said first strip.

3. A book according to claim 1 in which said studs are round in cross-section.

4. A book according to claim 1 in which said studs are rectangular in cross-section.

5. Strips for binding apertured sheets comprising a first strip, a second strip formed with at least four holes regularly spaced apart longitudinally of said second strip and a groove in the outer surface of said second strip for each said hole communicating with one of said holes, and a plurality of plastic studs integral with said first strip, each said stud extending outward from said first strip, said studs being flexible and bendable at approximately a 90° angle, the lengths of said grooves being complementary to said studs, and retaining means for retaining ends of said studs within said groove, said retaining means comprising overhangs along at least one longitudinal edge of each said groove adjacent only the outside of said groove, whereby the ends of said studs beyond said holes may be bent at approximately right angles and snapped under said overhangs, first teeth on said studs and, for each said groove, second teeth formed on at least one side of said groove complementary to said first teeth adjacent said second hole, said overhang extending from said second teeth to the end of said groove opposite said second hole and being smoothly surfaced.

6. Strips according to claim 5 in which said studs are integral with said first strip.

7. Strips according to claim 5 in which said studs are round in cross-section.

8. Strips according to claim 5 in which said studs are rectangular in cross-section.

9. Strips according to claim 8 in which said first teeth are formed only on opposed side edges of said studs.

10. A method of binding a book of the type having the steps of providing a plurality of sheets each formed with first holes spaced longitudinally of the spine edge of said sheet, a first strip, a second strip formed with a plurality of holes spaced at the same intervals as said first holes and a groove in one surface of said second strip communicating with said second holes, a plurality of studs, each said stud extending outward from said first strip, said studs being flexible and bendable at approximately a 90° angle, whereby the ends of said studs beyond said holes may be bent and received in said grooves and retaining means adjacent said grooves retaining said ends of said studs in said grooves, first teeth formed on said studs and, for each said groove, second teeth formed on at least one side of said groove complementary to said first teeth adjacent said second hole, said overhang extending from said second teeth to the end of said groove opposite said second hole and being smooth surfaced;

stacking said sheets with said first holes aligned;

inserting said studs through said first holes and said second holes; and bending the ends of said studs at approximately 90° angles into said grooves, meshing said first and second teeth and snapping said studs under said overhangs.

11. A method according to claim 10 in which said studs are integral with said first strip.

12. A method according to claim 10 which further comprises welding said bent ends to said second strip.

13. A method to claim 10 which further comprises unbending said studs to substantially upright position, removing said second strip from contact with said studs, adding or removing sheets from said stack, replacing said second strip, rebending the ends of said studs into said groove, and retaining the bent ends of said studs in said groove by remeshing said first and second teeth and also snapping the ends of said studs beyond the second teeth under the overhangs.

* * * * *